US008162726B1

(12) United States Patent
Jorgensen

(10) Patent No.: US 8,162,726 B1
(45) Date of Patent: Apr. 24, 2012

(54) EDGE DRESSING GRINDER TOOL

(75) Inventor: Kris Jorgensen, Mukilteo, WA (US)

(73) Assignee: NSI Solutions, LLC, Mukilteo, WA (US)

( * ) Notice: Subject to any disclaimer, the term of this patent is extended or adjusted under 35 U.S.C. 154(b) by 496 days.

(21) Appl. No.: 12/504,586

(22) Filed: Jul. 16, 2009

Related U.S. Application Data

(60) Provisional application No. 61/135,126, filed on Jul. 16, 2008.

(51) Int. Cl.
*B24B 23/00* (2006.01)

(52) U.S. Cl. ..... 451/344; 451/359; 451/363; 451/439; 451/449

(58) Field of Classification Search ..... 451/340, 451/342, 344, 347, 359, 363, 439, 449
See application file for complete search history.

(56) References Cited

U.S. PATENT DOCUMENTS

| | | | | |
|---|---|---|---|---|
| 3,828,484 | A * | 8/1974 | Baechle | 451/355 |
| 6,450,741 | B1 * | 9/2002 | Cannelli, Jr. | 409/138 |
| 6,592,440 | B2 * | 7/2003 | Mueller | 451/355 |
| 6,702,656 | B1 * | 3/2004 | Hibbert | 451/120 |
| 6,761,623 | B1 * | 7/2004 | Baker | 451/280 |
| 7,281,969 | B2 * | 10/2007 | Naples et al. | 451/371 |
| 2001/0036802 | A1 * | 11/2001 | Mueller | 451/355 |
| 2003/0224707 | A1 * | 12/2003 | Segiel, Jr. | 451/451 |
| 2004/0053565 | A1 * | 3/2004 | Hibbert | 451/120 |
| 2006/0217044 | A1 | 9/2006 | Volponi | |
| 2006/0258271 | A1 * | 11/2006 | Naples et al. | 451/45 |

FOREIGN PATENT DOCUMENTS

DE 10139256 A1 * 2/2003

* cited by examiner

*Primary Examiner* — Eileen P. Morgan
(74) *Attorney, Agent, or Firm* — Dean Craine

(57) ABSTRACT

An edge dressing grinder tool used for making a continuous straight, vertical edge on a concrete, natural stone or artificial stone slab used for a countertop or table. The tool includes a manually operated hand grinder with a perpendicularly aligned grinding disc or pad mounted on a drive shaft. Attached to the head of the grinder is a forward extending, longitudinally aligned bracket. Extending laterally from the bracket are two slide arms and an adjustment rod. Mounted on the distal ends of the slide arms is a guide plate with a low friction, sliding plate. Mounted along the rear edge of the guide plate are two, transversely aligned wheels that press against a raised edge formed on a rigid fence that is fixed in position on the top surface of the work piece and parallel to the edge. The end of the adjacent rod engages a nut assembly mounted on the slide plate that allows the distance between the grinder's head and the guide plate to be selectively adjusted.

3 Claims, 10 Drawing Sheets

EDGE DRESSING GRINDER TOOL

This utility patent application is based on and claims the benefit of the filing date of the U.S. provisional patent application (Ser. No. 61/135,126) filed on Jul. 16, 2008.

COPYRIGHT NOTICE

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention pertains to hand-held rotating grinders used for grinding vertical edges on concrete or stone slabs, and more particularly to attachments that can be selectively attached to the hand-held grinder.

2. Description of the Related Art

The kitchens and bathrooms in many homes today often have large countertops made of concrete, natural stone or artificial stone. Because such countertops are relatively large, and heavy, the countertops are often constructed on-site by a professional craftsman who meticulously cut and grind large and small pieces. In some instances, the grinded edge is exposed. In other instances, the edges are joined together along a seam that ideally, should be inconspicuous.

Because each piece of concrete or stone material can vary in color and have different grain patterns, the craftsman will often cut the pieces of material at locations so that the color and grain patterns on pieces joined together will match.

After each cut, the exposed edge is ground along its entire length with a hand grinder to eliminate edge chipping and ensure linearity. It is important that the hand grinder be held at constant pressure so that the grinder's grinding disc is flat against the exposed vertical edge. It is also important that the grinder be moved over the entire length of the vertical edge.

SUMMARY OF THE INVENTION

It is an object of the present invention to provide an edge-dressing grinder tool used to grind vertical edges on a concrete, natural stone or artificial stone work piece.

It is another object of the present invention to provide such a tool that allows the vertical edge of a small or large work piece made of concrete or artificial or natural stone to be ground in a straight line and in perpendicular alignment with the piece's top surface.

These and other objects are met by the tool disclosed herein that includes a hand grinder with a handle, a head attached to the handle, and a rotating grinding disc attached to the head. The tool also includes a forward extending, longitudinally aligned bracket that connects to the front surface of the head. Attached to the bracket and extending downward and parallel to the grinder drive axle are two outer slide rods and a central adjustment rod. Mounted on the two slide rods is a sliding guide plate with a low friction, sliding bottom surface. The guide plate is a flat plate structure perpendicularly aligned with the grinder's drive axle. The guide plate is able to selectively move longitudinally along the two slide rods thereby enabling the operator to move the hand grinder inward and outward from guide plate. The end of the adjustment rod engages a nut attached to the guide plate that enables the operator to lock the head of the grinder in a fixed position relative to the guide plate. Mounted along the rear edge of the guide plate are two, transversely aligned wheels.

The tool also includes an elongated flat fence designed to be positioned over the top surface of the work piece. The fence includes a front edge and a flat top surface. Mounted or formed on the top surface is at least one longitudinally aligned raised, lip that is parallel to the fence's front edge. During assembly, the bottom surface of the guide plate is positioned over the top surface of the fence while the two wheels are placed against the lip. Clamps are used to securely hold the ends of the fence in place on the work piece so that the longitudinally axis of the lip is parallel to the edge that is to be ground. The position of the grinder's head relative to the guide plate is adjusted so that the grinding disc is positioned against the edge. The guide plate is then positioned over the top surface of the fence and the grinder is then forced inward so that the two wheels continuously roll against the lip so that the grinder may be moved smoothly and easily back and forth over the edge. By rotating the adjustment rod, the head and the disc may be moved inward or outward with respect to the ground edge.

Formed on the bottom surface of the glide plate are optional water jet ports that enable water to be continuously or intermittently sprayed on the surface of the ground edge surface during the grinding process.

DESCRIPTION OF THE PREFERRED EMBODIMENT(S)

Figure 1:
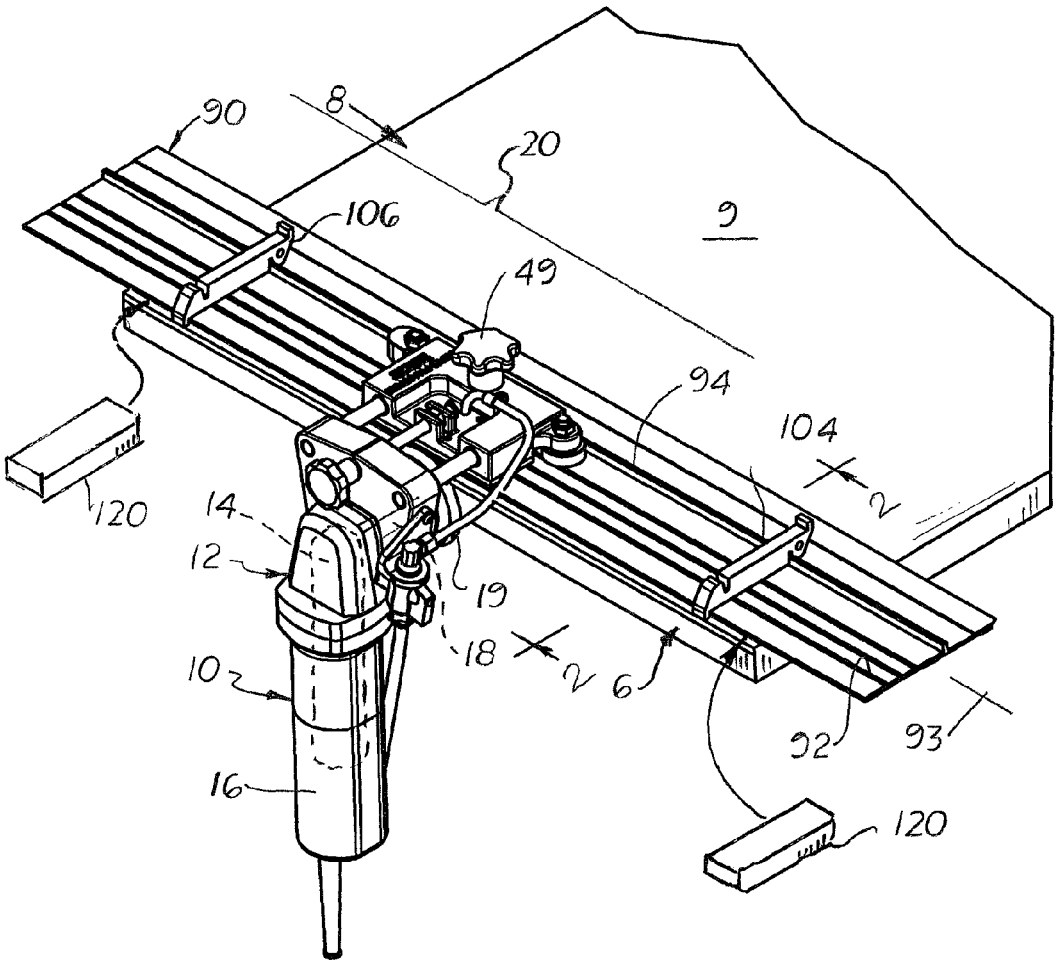
FIG. 1 is a perspective view of the stone edge dressing grinder tool used against a vertical edge on a flat work piece made of concrete or artificial or natural stone.
Figure 2:
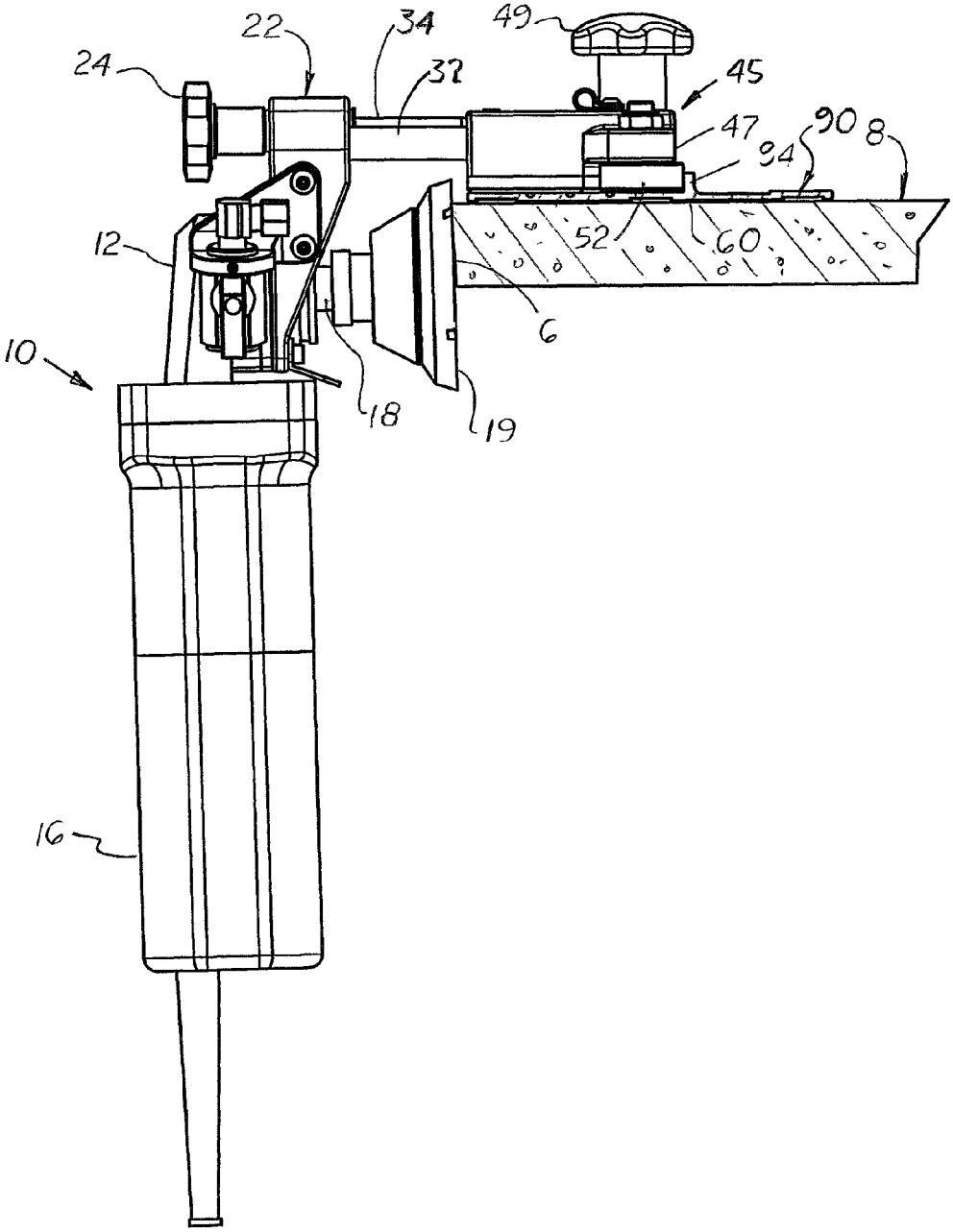
FIG. 2 is a sectional side elevational view taken along line 2-2 in FIG. 1.

Referring to FIGS. 1-11, there is shown and described a concrete or stone edge grinding tool 20 for finishing a straight, vertical edge 6 on a large work piece 8 used to make a countertop or table with an exposed edge or the two adjoining edges of two work pieces 8 joined together and form a seam. The tool 20 includes a standard hand grinder 10 that includes a head 12 containing an electric or air driven motor 14 with a rear extending handle 16 attached thereto. Attached to the motor 14 and extending laterally from the head 12 is a rotating drive axle 18 on which a grinding disc or pad 19 made for grinding the edge 6 of the work piece 8 made on a concrete, natural stone or artificial stone.

The tool 20 includes a bracket 22 that is longitudinally aligned and extends forward from the front edge of the grinder's head 12. Attached to the bracket 22 are two slide arms 32, 34 that are aligned parallel to the drive axle's longitudinally axis 18.

Attached to the distal ends of the two slide arms 32, 34 is a guide plate 45 with a low friction sliding surface 60. Mounted on the top surface 65 of the guide plate 45 are two ears 66, 68 with bores 67, 69 (see FIG. 3) formed therein that receive the distal ends of the slide arms 32, 34. Located centrally between the two ears 66, 68 is a central recessed cavity 70 designed to hold a threaded locking nut 75 that attaches to a threaded, centrally aligned adjustment rod 80 that extends laterally from the bracket 22. The adjustment rod 80 is parallel to the two slide arms 32, 34 with its proximal end extending through a bore 112 formed on the bracket 22. A turn knob 24 is fixed on the end of the rod 80 that allows the rod 80 to be manually rotated.

Figure 11:
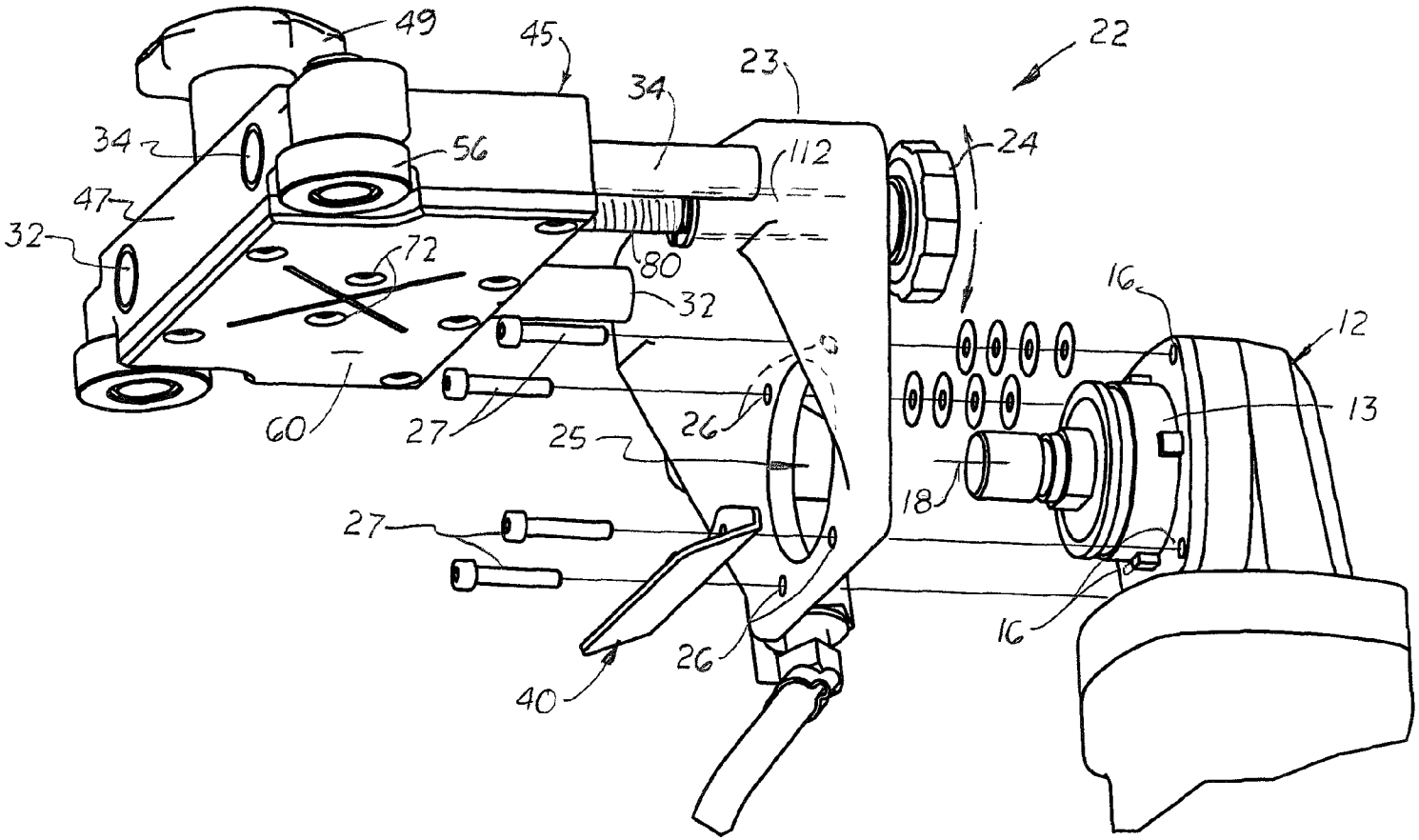
FIG. 11 is an exploded, perspective view of the grinder (without the grinding disc), the bracket and the guide plate.

As shown in FIG. 11, the bracket 22 includes a collar 23 with a large bore 25 formed therein designed to receive the neck 13 formed on the head 12. Formed on the collar 23 and evenly spaced apart around the large bore 25 are four smaller, non-threaded bores 26. During assembly, four threaded bolts 27 extend through the four bores 26 and connect to four threaded bores 16 (only three shown) formed on the inside surface of the grinder's head 12. Attached to the outside surface of the collar 23 is an optional spray shield 40 that prevents water over spray during use.

The guide plate 45 is a flat square or rectangular structure with a rear edge 47 aligned perpendicular to the slide arms 32, 34 and adjustment rod 80. Attached to the bottom surface of the guide plate 45 is a sliding plate 48 made of plastic, nylon, or TELFON (trademark owned by DuPont Corporation of New Jersey). Mounted along or near the rear edge 47 are two, horizontally aligned wheels 52, 56 that press against an upward extending edge formed on a fence 90. The two wheels are aligned on the guide plate 45 so that the slide surface of the guide plate 45 may rest evenly over the top surface of the fence 90. The raised lip 94 is continuous and longitudinally aligned on the fence 90. During set-up, it is positioned in a parallel aligned to the finished edge 6 and over the top surface 9 of the work piece 8. Mounted centrally on the guide plate 45 is an upward extending guide handle 49 that the operator uses to pull or push the grinder 10 longitudinally over the fence 90.

Two clamps 104, 106 are used to selectively attach the ends of the fence 90 in position over the work piece 8 so that the raised lip 94 is parallel to the edge 6 to be ground. In the preferred embodiment, the fence 90 is an elongated, flat structure with a flat top surface 92 and a raised straight lip 94 located approximately at the fence's center longitudinal axis 93. During use, the sliding surface 60 of the guide plate 45 slides smoothly over the top surface 92 of the fence 90 which the two wheels 52, 56 press against the edge 94 and move continuously against the raised straight lip 94. During use, the wheels 52, 56 are held tightly against the raised straight lip 94 by exerting an inward force with the knob 49 and simultaneously moving the guide plate 45 back and forth over the fence 90.

Figure 3:
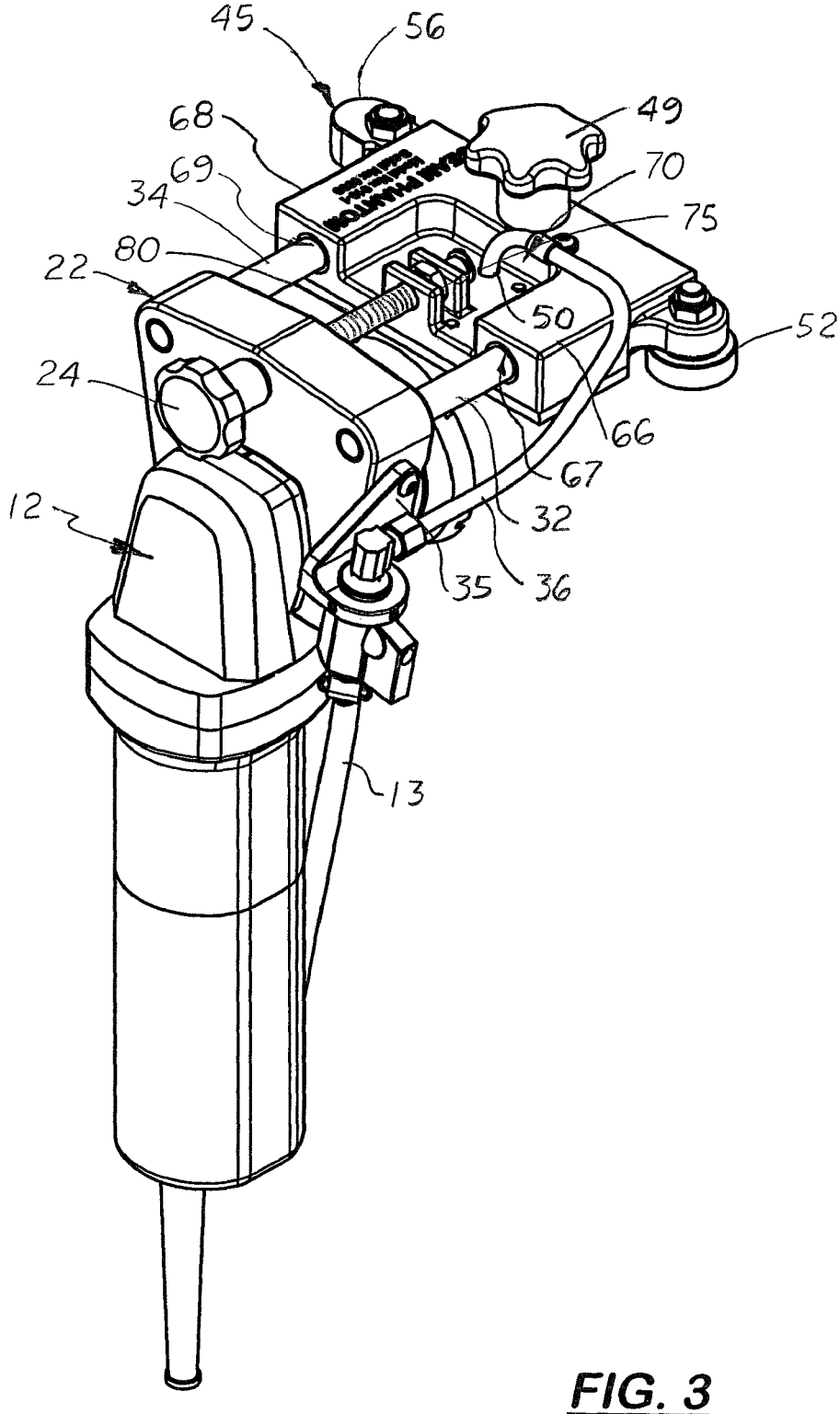
FIG. 3 is a perspective view of the grinder with the bracket and guide plate assembled together.
Figure 4:
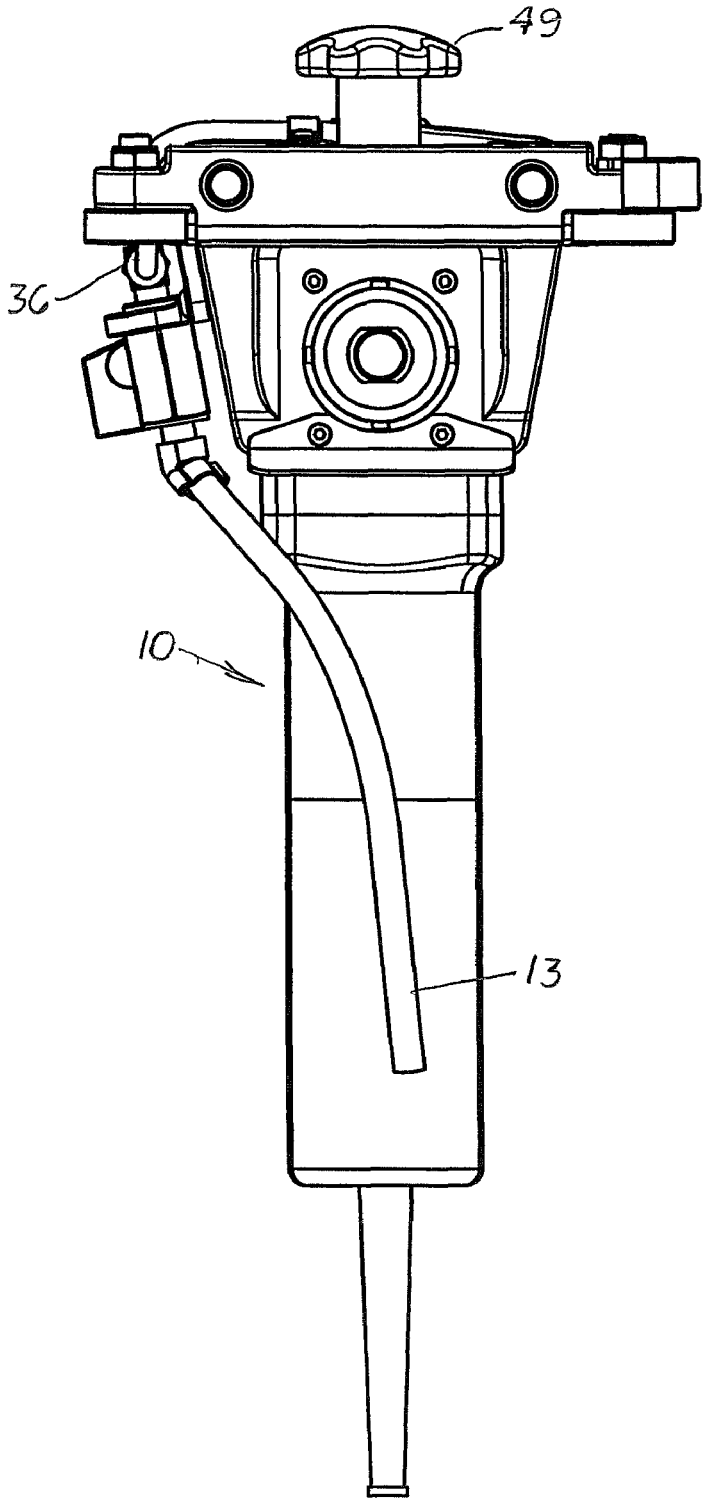
FIG. 4 is a front elevational view of the grinder, bracket, and guide plate shown in FIG. 3.
Figure 5:
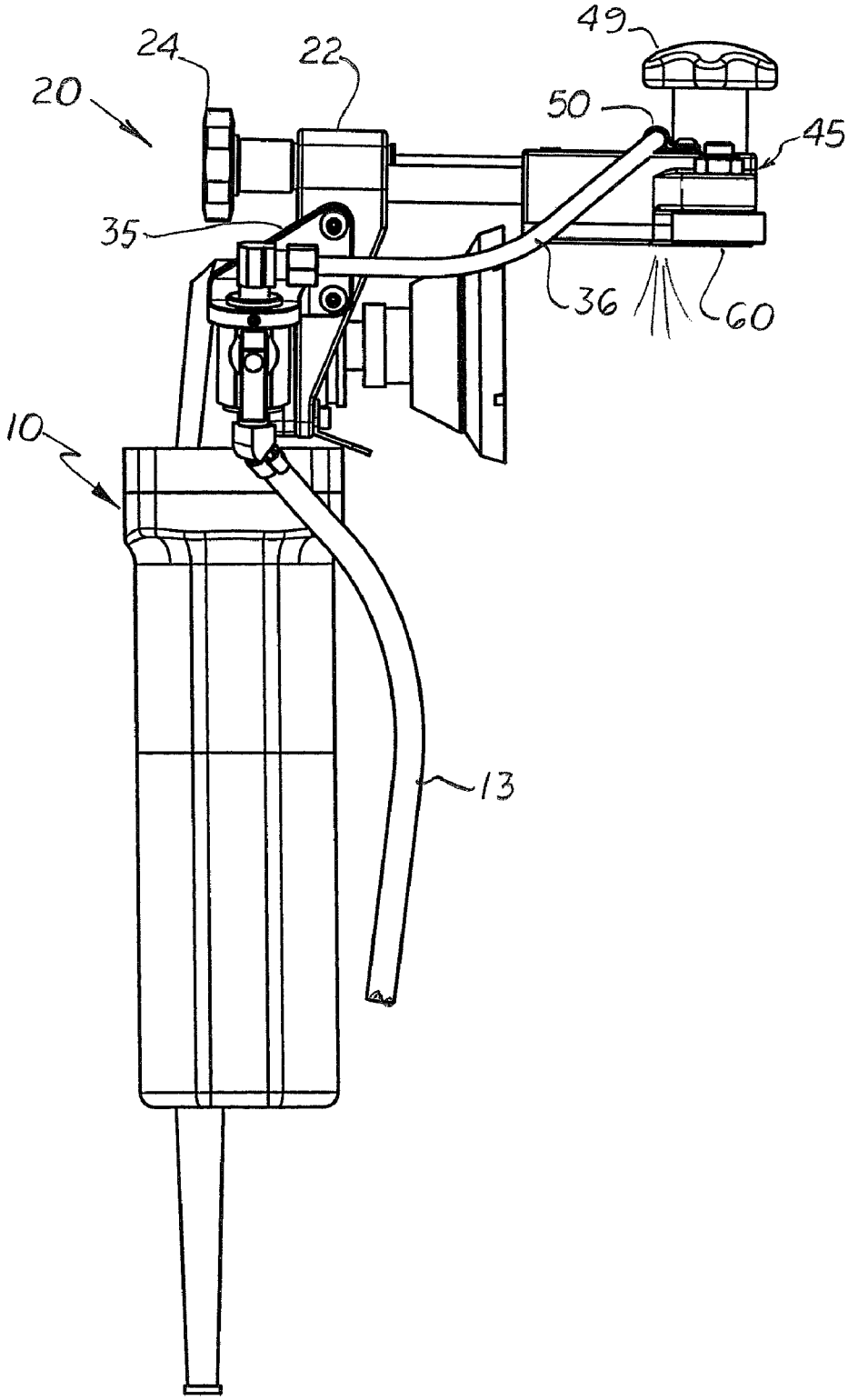
FIG. 5 is a left side elevational view of the grinder, bracket and guide plate shown in FIG. 3
Figure 6:
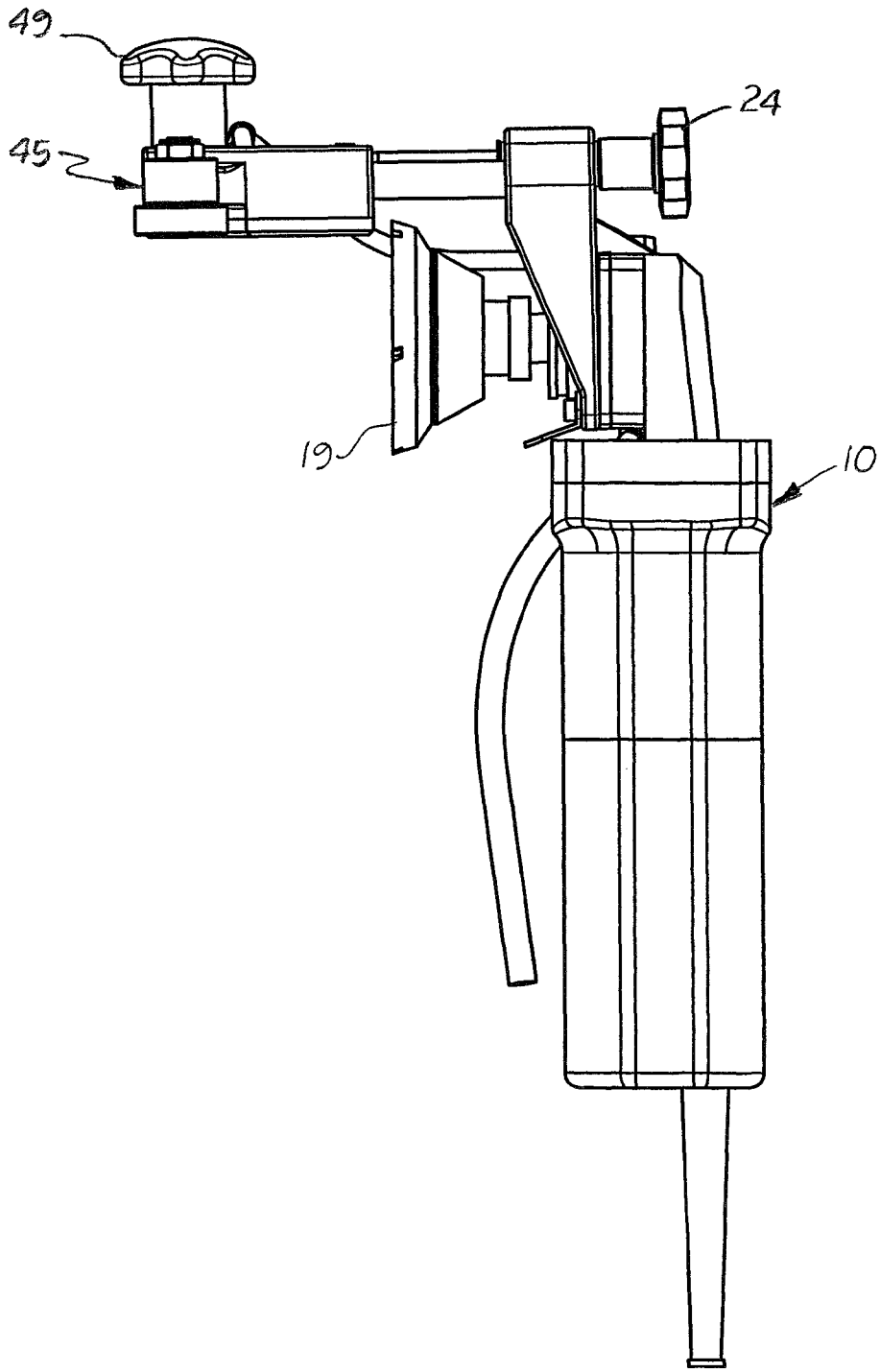
FIG. 6 is a right side elevational view of the grinder, bracket and guide plate shown in FIG. 3.
Figure 7:
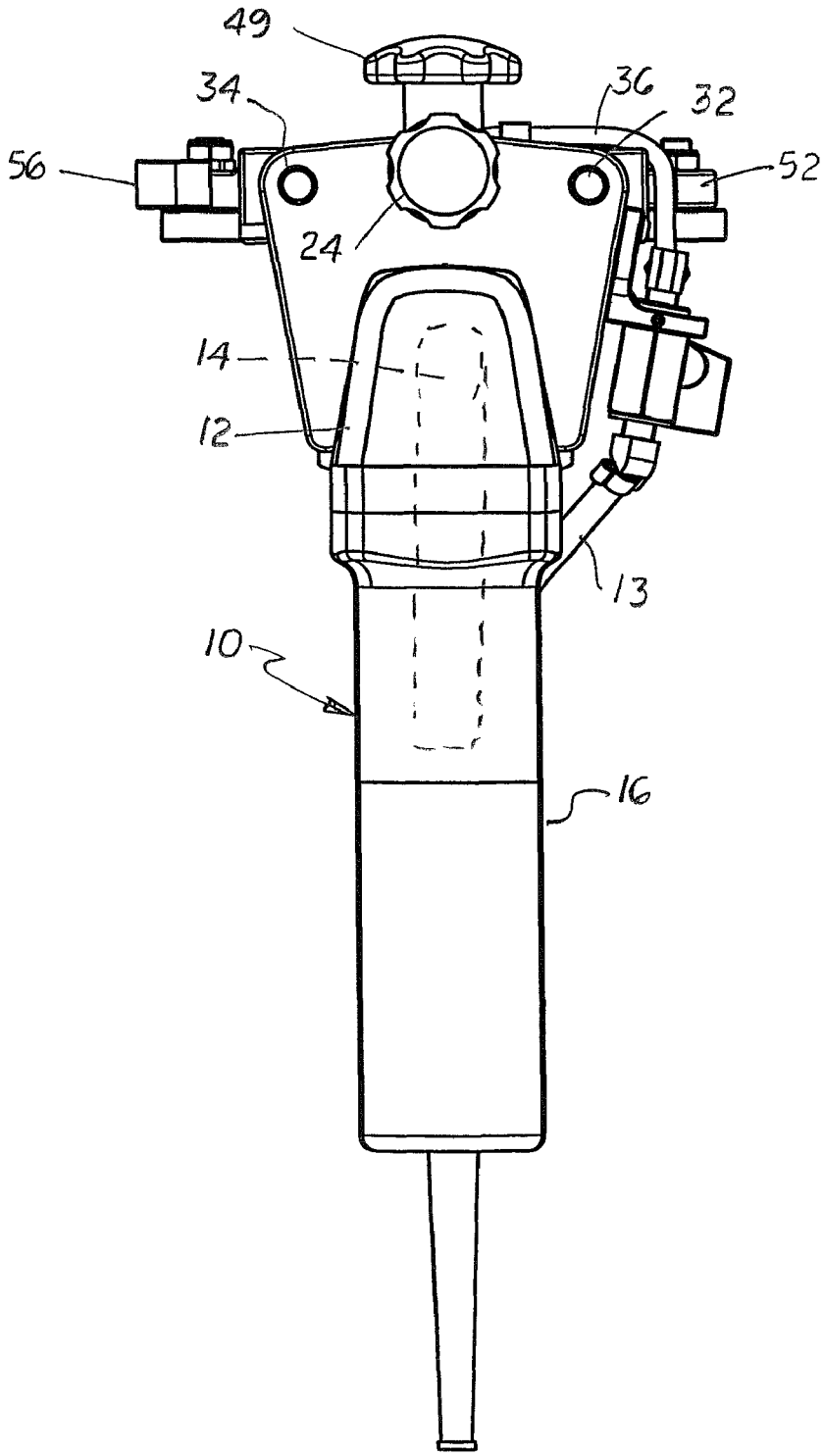
FIG. 7 is a rear elevational view of the grinder, bracket and guide plate shown in FIG. 3.
Figure 8:
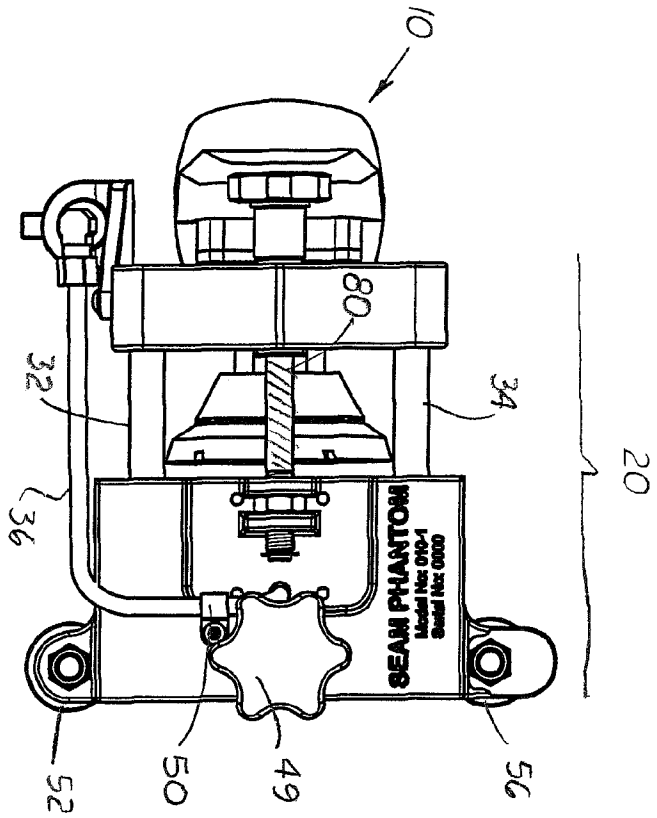
FIG. 8 is a top plan view of the grinder, bracket and the guide plate shown in FIG. 3.
Figure 9:
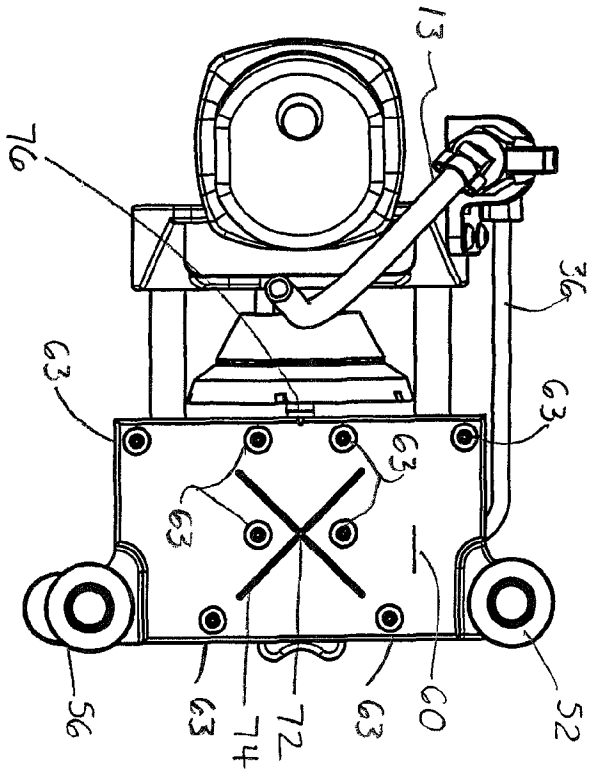
FIG. 9 is a bottom view of the grinder, bracket and guide plate shown in FIG. 3.
Figure 10:
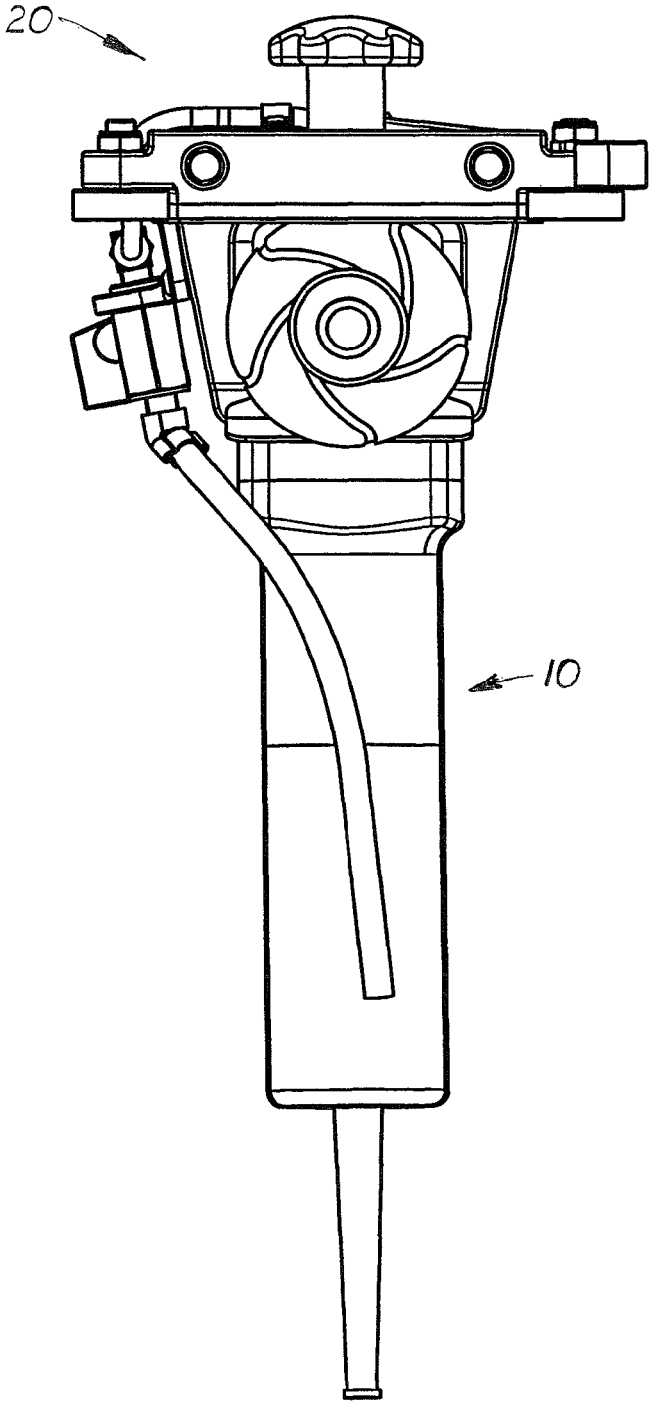
FIG. 10 is a front elevational view showing the grinder, the bracket and the guide plate with a grinding disc attached to the grinder.

As shown in FIGS. 3 and 4, attached to the side of the bracket 22 is an upward extending water tube support plate 35. Attached to the water tube support plate 35 is a short water hose 36 that connects to an input water port 50 formed on the guide plate 45. Attached to the opposite end of the water tube support plate 35 is a main water tube 13. As shown in FIGS. 9 and 11, formed on the slide surface 60 is a first water outlet port 72. X-crossing channels 74 are formed on the guide surface that enable water to flow over the top surface of the fence 90 and promote movement of guide plate 45 over the fence 90. A second outlet water port 76 is formed on the inside surface of the guide plate 45 which also connects to the input water port 50 to deliver water to the edge 6 during the grinding process. The slide plate 60 is attached to the glide plate 45 via screws 63 or rivets.

During use, the operator is able to finely adjust the position of the grinding disc by rotating the handle 24. By extending the fence 90 over the end of the work piece 8, the hand grinder 10 can be moved evenly and smoothly along the entire length of the edge 6 to form 90 degree corners. Because the handle 24 of the hand grinder 10 is pointed downward, the operator is able to continuous view the edge 6 as it is being ground. Also, by inserting shims 120 under the fence 90, the fence 90 can be raised over the top surface 9 of the work piece 8 which raises the grinder 10 so that undercuts may be formed on the edge 6.

In the preferred embodiment, the guide plate 45 is approximately 3 to 4 inches wide 4 to 6 inches in length. The fence 90 is approximately 6 to 10 inches in width and 48-120 inches in length. The portion of the top surface 9 of the fence 90 where the guide plate 45 slides back and forth is approximately equal to the width of the guide plate 45. The width of the wheels 53, 56 are approximately ⅜ inch and the hip 94 extends upward approximately ½ inch. The slide rods 32, 34 and adjustment rod 80 are ¼ to ½ inch in diameter and 4 to 8 inches in length. In the preferred embodiment, the bracket, the guide plate 45, and slide rods 32, 34 and the adjustment rod 80 are made of aluminum or stainless steel.

In compliance with the statute, the invention described herein has been described in language more or less specific as to structural features. It should be understood however, that the invention is not limited to the specific features shown, since the means and construction shown, is comprised only of the preferred embodiments for putting the invention into effect.

The invention is therefore claimed in any of its forms or modifications within the legitimate and valid scope of the amended claims, appropriately interpreted in accordance with the doctrine of equivalents.

I claim:

1. An edge grinding tool, comprising:

a. a grinder with a forward extending head containing a motor and a perpendicularly aligned drive axle attached to said motor, said grinder includes a grinding disc attached to said drive axle used to grind an edge of a work piece;

b. a forward bracket attached to said head on said grinder;

c. two parallel slide arms extending laterally from said bracket, said slide arms being parallel to said drive axle;

d. a guide plate slidingly attached to said slide arms, said guide plate includes a lower glide surface;

e. an adjustable rod disposed between said bracket and said guide plate, said adjustable rod when rotated selectively moves said guide plate along said slide arm and locks said guide plate in a fixed position on said slide arms;

f. at least two transversely aligned wheels attached to said rear edge of said guide plate;

g. a straight fence with a top surface at least one upper extending lip that extends longitudinally over said top surface, said lip being sufficient in height so that when said guide plate is forced inward, said wheels may roll along said lip enabling said guide plate to move smoothly back and forth over said top surface of said fence; and, h. a means for clamping said fence to the top surface a work piece so that said upper extending lip is substantially parallel to the edge on the work piece to be ground.

2. The edge grinding tool, as recited in claim 1, further including a water outlet port formed on said guide plate to dispense water over said fence or said edge to be ground.

3. The edge grinding tool, as recited in claim 1, further including a handle mounted on said guide plate that enables an operator to grip said guide plate and move it back and forth over said fence.

* * * * *